United States Patent [19]

Blackburn

[11] Patent Number: 4,776,308

[45] Date of Patent: Oct. 11, 1988

[54] PISTON ENGINES

[76] Inventor: Anthony E. Blackburn, Elton House, 1 Lord Selton Way, Formby, Liverpool, United Kingdom, L 37 5AA

[21] Appl. No.: 929,109

[22] PCT Filed: Feb. 12, 1986

[86] PCT No.: PCT/GB86/00074

§ 371 Date: Oct. 14, 1986

§ 102(e) Date: Oct. 14, 1986

[87] PCT Pub. No.: WO86/04955

PCT Pub. Date: Aug. 28, 1986

[30] Foreign Application Priority Data

Feb. 15, 1985 [GB] United Kingdom ..... 8503964

[51] Int. Cl.[4] ..... F02F 3/00

[52] U.S. Cl. ..... 123/193 P

[58] Field of Search ..... 123/193 R, 193 CP, 193 P

[56] References Cited

U.S. PATENT DOCUMENTS

| | | | |
|---|---|---|---|
| 1,305,567 | 6/1919 | Ritter | 123/193 P |
| 2,686,512 | 8/1954 | Beam | 123/193 P |
| 2,791,991 | 5/1957 | Ickes | 123/193 P |
| 4,359,976 | 11/1982 | Steele | 123/193 P |

FOREIGN PATENT DOCUMENTS

| | | | |
|---|---|---|---|
| 2722176 | 11/1978 | Fed. Rep. of Germany | 123/193 P |
| 0691592 | 10/1979 | U.S.S.R. | 123/193 P |
| 0885581 | 11/1981 | U.S.S.R. | 123/193 P |
| 0928052 | 5/1982 | U.S.S.R. | 123/193 P |
| 2122722 | 1/1984 | United Kingdom | 123/193 P |

*Primary Examiner*—Charles J. Myhre
*Assistant Examiner*—David A. Okonsky
*Attorney, Agent, or Firm*—Fitch, Even, Tabin & Flannery

[57] ABSTRACT

A four stroke engine cylinder (10) has a main chamber (12) and a main piston (16) reciprocally movable therein. The main piston (16) itself contains a secondary chamber in which a secondary piston (24) is reciprocally movable. The connecting rod (26) is connected to the secondary piston (24).

12 Claims, 2 Drawing Sheets

PISTON ENGINES

This invention concerns piston engines.

In piston engines, particularly 4-stroke petrol engines, the exhaust residue is hot and it preheats the fresh fuel-/air mixture. This preheating causes the mixture in the cylinder to be relatively hot at the start of combustion. However, because the mixture is relatively hot, the heat added by the combustions of the fuel produces a smaller increase in pressure and less power.

If the amount of the exhaust residue could be reduced than the temperature of the fuel/air mixture in the cylinder would be reduced. That would mean that the same heat and fuel would produce a greater pressure and more power. As the amount of the exhaust residue was reduced so the proportion of fresh fuel/air mixture would be increased, which would further increase the combustion pressure and power output for a given quantity of fuel.

Furthermore it would be desirable to have a clearance at the end of the compression that was related to the desired pressure of fuel mixture in the cylinder for optimum economy.

The object of this invention is to provide a four stroke engine powered by a fuel/air mixture wherein piston clearances in its cyclinders can vary according to the pressure within the cylinder.

According to this invention there is provided a four-stroke engine wherein piston clearance is dependent on the pressure within the cylinder.

Preferably the pistons have a smaller clearance from the cylinder head at the end of their exhaust stroke than at the end of the compression stroke. In this way virtually all of the hot exhaust residues will be expelled from the cylinder so that the temperature of the next fuel/air mixture input will be lower. Thus less heat and fuel will be required for a desired power output.

At the end of the compression stroke the clearance of the piston from the cylinder head will be greater than at the end of the exhaust stroke. That is because of the pressure of the fuel/air mixture in the cylinder but as the clearance is dependent on the pressure within the cylinder the compression ratio will be favourable.

The above applies not only to an engine under normal load conditions but also under light or heavy load conditions because the engine has the ability to vary its piston clearances in accordance with the pressure within the cylinder whether as a reduced pressure at light load or higher pressure at heavy load.

In a preferred embodiment the pistons of the engine each have a secondary piston reciprocally movable in a chamber in the main piston. The connection of each main piston to its connecting rod is via its secondary piston. For retention of the secondary piston in the main piston, the secondary piston may have a lateral extension or flange retained in a wider part of the chamber.

The secondary piston preferably provides two substantially sealed spaces above and below the lateral extension or flange. Sealing is preferably by way of piston rings. At the end of the exhaust stroke there is no significant pressure in the cylinder so that the inertia of the main piston causes it to move close to the cylinder head relatively unhindered by the weight or movement of the connecting rod. This is because said lower space volume is compressed whilst the upper space volume expands. The movement of the main piston close to the cylinder head expels virtually all of the hot exhaust gases from the cylinder so reducing the temperature therein for the next input of fuel/air mixture, which as mentioned above is desirable.

On the compression stroke the fuel/air mixture in the cylinder opposes the movement of the main piston towards the cylinder head. This means that the upper space volume is compressed as the secondary piston tries to assist movement of the main piston towards the cylinder head. At the same time, of course, the lower space volume increases.

During sustained heavy load, low speed, conditions, which might normally cause detonation or knock, the piston system of the invention can provide more clearance volume (less inertia—more compression). A higher nominal compression ratio can, therefore, be selected. During light load, high speed, conditions, the piston system of the invention can give higher actual compression ratio and improved economy (more inertia—less pressure). The engine of the invention is suitable for lead-free fuel for lower emission, and the pistons can be free to rotate thus equalising wear.

Small notches may be provided, preferably in the inner wall of the main piston, adjacent to the secondary piston sealing rings to allow the system to self-centralize automatically and for oil transfer. These notches may or may not be at the mid-stroke position or open at the same time. Two notches or sets of notches are preferably provided one for each of the upper and lower spaces. Both notches are preferably slightly wider than the piston rings. If the lower notch is open near the top of the secondary piston stroke, this increases the average pressure in the spaces and increases clearances.

As an alternative to the notches, one or more vent holes may be provided in the wall of the outer main piston so that any loss of gases from the secondary or pneumatic chambers can be replaced with gases drawn from the engine crankcase. Regulating means, such as valves, can be used to regulate the general crankcase pressure, which in turn regulates the pressure in the pneumatic or secondary chambers to enhance the effect of the secondary piston. The vent holes can also transfer lubricating oil from the crankcase to the secondary chambers.

A pressure oil supply may be needed for the piston system and/or a ball-jointed little-end.

This invention will now be further described, by way of example only, with reference to the accompanying drawings, in which.

Figure 2:
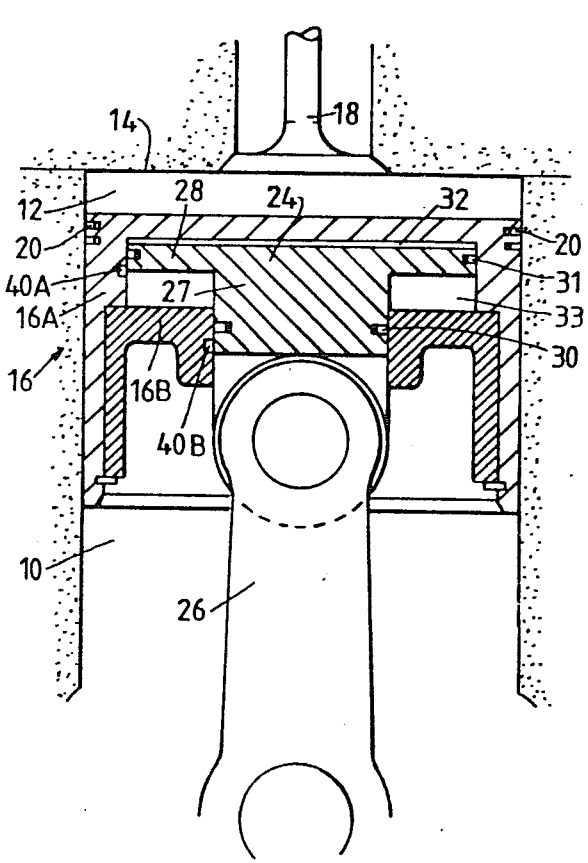
FIG. 2 shows the same cylinder at the end of the compression stroke.
Figure 1:
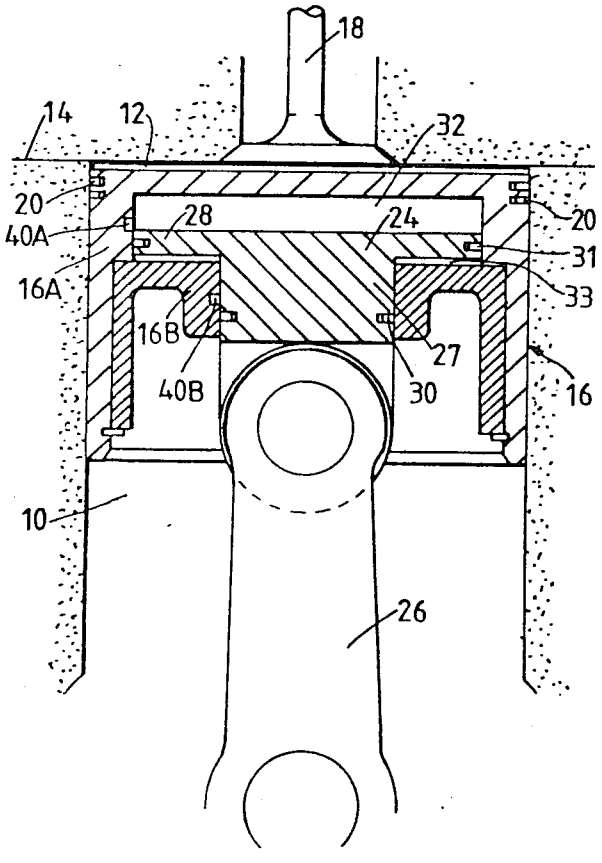
FIG. 1 shows a first embodiment wherein one cylinder of a four-stroke engine is at the end of its exhaust stroke.

Referring to FIG. 1 and 2 of the accompanying drawings, a four-stroke engine cylinder 10 comprises a chamber 12 closed at one end by cylinder head 14 and having a main piston 16 reciprocally movable in the chamber. The cylinder head 14 has a pair of valves 18 (only one shown) one whereby exhaust gases are expelled and the other whereby a fuel/air mixture is entrant. The main piston 16 has piston rings 20 for sealing. Within the main piston 16, shown as being of two-part construction (16A, 16B), is a secondary piston 14 that is connected to connecting rod 26 which in turn is connected to a crankshaft (not shown).

The secondary piston 24 has a cylindrical part 27 and a flange-like part 28 integral therewith. The piston 24 is reciprocally movable within the main piston 16 and is sealed by means of piston rings 30 and 31. The flange 28 forms two spaces 32 and 33 above and below itself.

Two equalizing notches 40A, 40B are provided in the inner wall of the main piston 16. Both are preferably slightly wider than piston rings with which they cooperate.

In operation, the main piston 16 is free to move upwards in the cylinder in response to the pressure therein. Thus in the exhaust stroke the pressure is low so that the inertia of the main piston causes it to move close to the cylinder head thus expelling virtually all of the exhaust gases. However, in the compression stroke, the pressure is high so that the clearance between the pistons and the cylinder head at T.D.C. is greater than for the exhaust stroke. Furthermore, under different load conditions, the pressure in the chamber will be different and the main piston will move to give an appropriate clearance.

This is due to the volume of the spaces 32 and 33 to be varied according to the pressure in the cylinder allowing the main piston 16 to move relative to the connecting rod at T.D.C. for both the exhaust and compression strokes.

It will be appreciated that causing the lower (40B) of the notches to be open near the top of the inner piston stroke will increase the average gas pressure in the chambers or spaces above and below the secondary piston 24, and increases clearances.

Also, of course any or all of the piston rings could be plural-ring systems and/or of stepped gap type.

Figure 5:
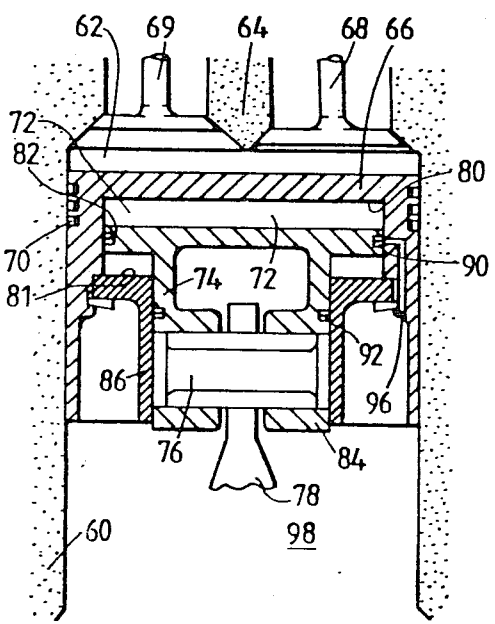
FIG. 5 shows that same cylinder at the end of compression idling at low inertia and pressure.
Figure 4:
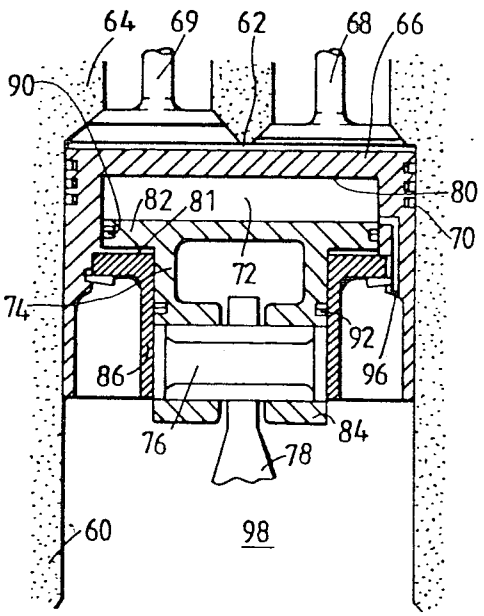
FIG. 4 shows the same cylinder at the end of exhaust and high r.p.m.
Figure 3:
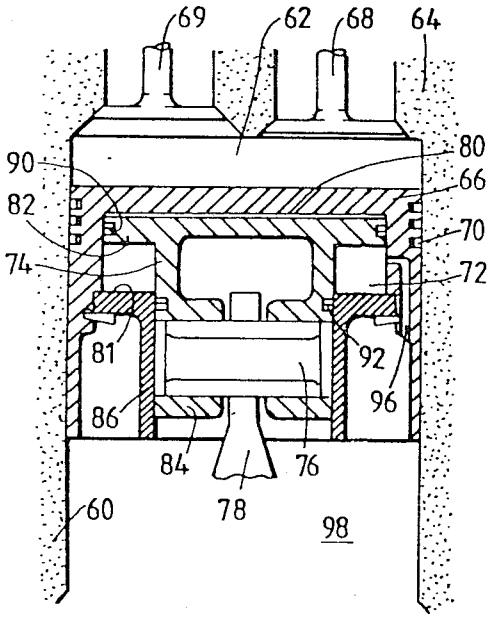
FIG. 3 shows a second embodiment wherein one cylinder of a four-stroke engine is at the end of compression at full torque and low r.p.m.

Turning to FIGS. 3 to 5 of the accompanying drawings, a four-stroke engine cylinder 60 comprises a chamber 62 closed at one end by a cylinder head 64 and having a main piston 66 reciprocally movable in the chamber 62. The cylinder head has a valve 68 for introduction of fuel/air mixture to the chamber 62 and a valve 69 for escape of exhaust gases from the chamber 62. The exhaust valve 69 is in a recessed valve seat compared to the entry valve 68. The main piston 66 has piston rings 70 for sealing.

Within the main chamber 62 is a secondary chamber 72 contains a secondary piston 74 connected by a gudgeon pin 76 to connecting rod 78 that is in turn connected to the crankshaft (not shown) of the engine.

The piston 74 has an upper flanged part 82 that is reciprocally movable between the upper inner surface 80 of the chamber 72 and the upper surface 81 of closure member 86 within the open centre of which the lower part 84 of the piston moves. Piston rings 90 and 92 provide seals between the piston 74 and the chamber 72

Instead of the notches 40A, 40B of FIGS. 1 and 2 vents 96 are provided between the secondary chamber 72 and the crankcase 98. Operation of the embodiment of FIGS. 3 to 5 is, however, generally the same as the operation of the embodiment of FIGS. 1 and 2.

I claim:

1. A four-stroke engine including one or more cylinders, each cylinder having a main piston associated therewith, each main piston defining an open region therein; connecting means for retaining each main piston for reciprocal movement in the associated cylinder, said connecting means including a connecting rod and a secondary piston reciprocally movable within the open region of the main cylinder, the connecting rod being affixed to the secondary piston whereby the connection of the main piston to its connecting rod is via its secondary piston; the secondary piston having sealing rings whereby the secondary piston forms a substantially closed chamber in the main piston open region, small notches are provided adjacent to the secondary piston sealing rings, the notches are in the main piston inner wall.

2. An engine as claimed in claim 1 wherein the secondary piston has a lateral extension or flange retained in a wider part of the chamber.

3. An engine as claimed in claim 1 wherein at least one vent hole is provided in the main piston so that any loss of gases from the chambers can be replaced with gases drawn form the engine crankcase.

4. An engine as claimed in claim 1, wherein the secondary piston provides two substantially sealed spaces above and below the lateral extension or flange.

5. An engine as claimed in claim 4, wherein two notches or sets of notches are provided one for each of the upper and lower spaces.

6. An engine as claimed in claim 5, wherein both notches are slightly wider than the piston rings.

7. A four stroke piston engine comprising main pistons each having a secondary piston reciprocally movable in a chamber therein, each main piston being connected to its connecting rod via its secondary piston, the secondary pistons each having lateral extension retained in a wider part of the chamber which provides substantially sealed pneumatic spaces above and below the lateral extension, and means for equalizing pressure in said upper and lower spaces, whereby the pistons have a smaller clearance from the cylinder head at the end of each exhaust stroke than at the end of the compression stroke.

8. A four stroke piston engine as claimed in claim 7 wherein the means for equalizing pressure in said upper and lower spaces comprises notches adjacent to secondary piston sealing rings.

9. An engine as claimed in claim 8 wherein one or more vent holes are provided in the wall of the outer main piston so that any loss of gases from the secondary or pneumatic chambers can be replaced with gases drawn from the engine crankcase.

10. An engine as claimed in claim 8, wherein the notches are in the main piston inner wall.

11. An engine as claimed in claim 10 wherein two notches or sets of notches are provided one for each of the upper and lower spaces.

12. An engine as claimed in claim 11, wherein both notches are slightly wider than the piston rings.

* * * * *